US010145127B2

(12) United States Patent
Kufner

(10) Patent No.: US 10,145,127 B2
(45) **Date of Patent: *Dec. 4, 2018**

(54) ASSEMBLIES AND METHODS FOR ALIGNING AND LEVELING TILES

(71) Applicant: Davinci Italia/USA Group, LLC, Fairfield, IA (US)

(72) Inventor: Edward A. Kufner, Fairfield, IA (US)

(73) Assignee: Davinci Italia/USA Group, LLC, Fairfield, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/805,792

(22) Filed: Nov. 7, 2017

(65) Prior Publication Data

US 2018/0202174 A1 Jul. 19, 2018

Related U.S. Application Data

(63) Continuation of application No. 15/407,725, filed on Jan. 17, 2017, now Pat. No. 9,834,943.

(51) Int. Cl.

| | |
|---|---|
| ***E04F 21/00*** | (2006.01) |
| ***E04F 21/18*** | (2006.01) |
| ***E04F 21/20*** | (2006.01) |

(52) U.S. Cl.

CPC ..... *E04F 21/20* (2013.01); *E04F 21/0092* (2013.01); *E04F 21/1877* (2013.01)

(58) Field of Classification Search

CPC ..... E04F 21/20; E04F 21/22; E04F 21/0092; E04F 21/1877; E04F 13/0892; E04F 15/02022

See application file for complete search history.

(56) References Cited

U.S. PATENT DOCUMENTS

| | | | | |
|---|---|---|---|---|
| 5,675,942 | A * | 10/1997 | Crawford | E04F 13/0892 52/127.3 |
| 7,257,926 | B1 * | 8/2007 | Kirby | E04F 21/0092 33/526 |
| 7,621,100 | B2 | 11/2009 | Kufner et al. | |
| 7,861,487 | B2 | 1/2011 | Kufner et al. | |

(Continued)

OTHER PUBLICATIONS

PCT/US17/65788 Search Report and Written Opinion—dated Jan. 18, 2018.

*Primary Examiner* — Brian D Mattei

(74) *Attorney, Agent, or Firm* — Nyemaster Goode, PC

(57) ABSTRACT

A method and assembly for laying and leveling adjacent tiles. The assembly includes a base member having a bottom plate and a cam tool. The cam tool is pivotally combined with the base member so that the cam tool rotates relative to the base member about an axis of rotation. The cam tool has a handle combined with a cam member. The cam member has a tile engaging surface around its outer periphery with a first portion that is a first distance from the axis of rotation and a second portion that is a second distance from the axis of rotation. Rotation of the cam tool around the axis of rotation causes the distance between the tile engaging surface and the bottom plate to change. One or more tiles is adapted to be placed between the tile engaging surface of the cam member and the bottom plate of the base member. The tiles are compressed between the tile engaging surface and the bottom plate as the cam tool is rotated to a desired position.

13 Claims, 13 Drawing Sheets

(56) References Cited

U.S. PATENT DOCUMENTS

| | | | | |
|---|---|---|---|---|
| 8,079,199 | B1 * | 12/2011 | Kufner | E04F 13/0892 33/526 |
| 8,181,420 | B2 | 5/2012 | Torrents I Comas | |
| 8,429,879 | B1 * | 4/2013 | Hoffman | E04F 21/0092 52/747.11 |
| 8,607,530 | B2 * | 12/2013 | Hoffman | E04F 21/00 52/747.11 |
| 8,820,031 | B2 | 9/2014 | Kufner et al. | |
| 9,097,026 | B2 | 8/2015 | Hoffman et al. | |
| 9,260,872 | B2 | 2/2016 | Bunch | |
| 9,470,002 | B2 | 10/2016 | Irvine et al. | |
| 9,657,485 | B2 * | 5/2017 | Meyers | E04F 21/1877 |
| 9,840,850 | B2 | 12/2017 | Teng | |
| 2006/0185319 | A1 * | 8/2006 | Kufner | E04F 13/0892 52/749.11 |
| 2010/0263304 | A1 * | 10/2010 | Torrents I Comas | E04F 21/0092 52/126.5 |
| 2010/0287868 | A1 * | 11/2010 | Kufner | E04F 21/0092 52/391 |
| 2013/0255182 | A1 * | 10/2013 | Kufner | E04F 21/22 52/749.11 |
| 2014/0298736 | A1 * | 10/2014 | Bunch | E04F 21/0092 52/126.1 |
| 2014/0325935 | A1 * | 11/2014 | Hoffman | E04F 21/22 52/747.11 |
| 2017/0211282 | A1 * | 7/2017 | Teng | E04F 21/20 |

* cited by examiner

ASSEMBLIES AND METHODS FOR ALIGNING AND LEVELING TILES

This application is a continuation of U.S. patent application Ser. No. 15/407,725 filed on Jan. 17, 2017, the complete disclosure of which is hereby expressly incorporated by this reference.

BACKGROUND

This invention is directed to the field of laying and leveling tile. More particularly, the invention is directed to an assembly for aligning and leveling adjacent tiles as they are laid in floors, walls, countertops, or the like.

Tile has become a popular decorative and functional article for use in floors, walls, countertops, and the like. Both professional tile installers and do-it-yourselfers spend a great deal of time aligning and leveling tiles as the tiles are being placed on a substrate's surface. Proper alignment and leveling of each tile is important for a number of reasons. One reason is that if one tile is improperly placed, the error will continue in adjacent tiles such that the installation will be unacceptable and the tiles will have to be replaced and/or ground and polished until the tiles are level or flat. In addition to aesthetic reasons for properly laying tile, a level surface is essential in tile floors so that people do not trip on unevenly laid tiles. Replacing or otherwise correcting errors in tile installation takes time that adds to the total cost of the installation.

Laying and leveling tile can be difficult because many substrates are uneven, such as the ground substrate when laying tile for an outdoor patio. In this case, it can be difficult to raise the low areas of the substrate with mortar or other objects so that all the tiles are level. Further, tiles can shift and sink into mortar as the mortar dries. It has traditionally been necessary to continually monitor newly laid tiles as the mortar dries to ensure that the tiles remain level. Tile installers have used a variety of devices and methods to maintain quality tile installation while completing the installation process as fast as possible. One basic method uses markings on the substrate surface. Marking the installation surface requires the mortar to be carefully applied such that the marks remain visible. Although this technique aids in the alignment of the tiles, it does not keep the tiles level as they are laid in the mortar. Further, the use of this marking technique increases the amount of time required for the installation which results in increased cost.

Another device used for laying and leveling tile is a frame designed to space tiles at an appropriate distance. This type of frame is typically a fixed grid which is designed for a specific tile size. The disadvantage of this type of device is that it is a fixed size which requires a professional installer to carry multiple frames in order to be capable of installing various tile sizes. A further disadvantage of this type of frame is that it is only capable of installing one type of tile at a time.

Another device used to lay and align adjacent tiles leveling device such as the one shown and described in U.S. Pat. No. 8,181,420 (Torrents I Comas) wherein a cap slides downward along a shaft to secure the tile between the cap and a bottom plate. One drawback with this device is that a tightening tool is necessary to tighten the cap against the tile. The use of a tightening tool can increase the time it takes to complete the installation because the shaft of each leveling device must be threaded through an opening in the tightening tool in order for the tightening tool to tighten the cap against the tile.

Therefore, there is a need for an efficient and inexpensive tile leveling and alignment device which overcomes the drawbacks in the prior art and does not require threading a tightening tool onto an elongated shaft.

SUMMARY

One aspect of the invention relates to an assembly for laying and leveling adjacent tiles. The assembly includes a base member having a bottom plate and a cam tool. The cam tool is pivotally combined with the base member so that the cam tool rotates relative to the base member about an axis of rotation. The cam tool has a handle combined with a cam member. The cam member has a tile engaging surface around its outer periphery with a first portion that is a first distance from the axis of rotation and a second portion that is a second distance from the axis of rotation. Rotation of the cam tool around the axis of rotation causes the distance between the tile engaging surface and the bottom plate to change. The cam member's tile engaging surface may be curved or it may by the shape of a polygon comprising a plurality of separate generally straight sides separated by vertices. One or more tiles is adapted to be placed between the tile engaging surface of the cam member and the bottom plate of the base member and compressed as the cam tool is rotated to a desired position.

Another aspect of the invention relates to an assembly for laying and leveling adjacent tiles. The alignment assembly comprises a base member having a bottom plate and an intermediate member extending upwardly from the bottom plate. The intermediate member has a first side and a second side, wherein the first and second sides of the intermediate member have an engagement member extending outwardly therefrom. The assembly further comprises a cam tool having a handle combined with a first cam member and a second cam member, wherein each cam member has a tile engaging surface around its outer periphery, and wherein each tile engaging surface has a first portion that is a first distance from an opening that defines an axis of rotation and a second portion that is a second distance from the axis of rotation. The engagement member extending from the base member is adapted to receive the opening in the cam member thereby allowing the cam tool to rotate relative the base member so that the first cam member is on one side of the intermediate member and the second cam member is on a second side of the intermediate member. Rotation of the cam tool around the axis of rotation causes the distance between the tile engaging surface and the bottom plate to change. The cam member's tile engaging surface may be a smooth curve or it may by the shape of a polygon comprising a plurality of separate generally straight sides separated by vertices. One or more tiles is adapted to be placed between the tile engaging surface of the cam member and the bottom plate of the base member and compressed as the cam tool is rotated to a desired position.

Yet another aspect of the invention relates to an assembly for laying and leveling adjacent tiles. The assembly generally includes a cam tool adapted to engage and rotate relative to a base member. The cam tool has a handle combined with a cam member, the cam member has a plurality of generally flat tile engaging surfaces around its outer periphery angled relative to each other, wherein each tile engaging surface is a different distance from an opening that defines an axis of rotation. In one embodiment the plurality of flat tile engaging surface form a polygon or a portion of a polygon (i.e., a polygon which is not completed or closed). The opening includes an engagement surface. The base member has a bottom plate and an intermediate member extending upwardly from the bottom plate. The intermediate member includes at least one engagement member such as a hub or shaft extending outward. The engagement surface of the cam member's opening is adapted to engage and rotate around the engagement member. One or more tiles is adapted to be placed between the tile engaging surface of the cam member and the bottom plate of the base member. Since the rotation axis is off-center, each tile engaging surface is a different distance from the bottom plate when facing downward thereby the tile(s) to be compressed between the cam member and the bottom plate.

Another aspect of the invention is similar to the one described in the previous paragraph except that the cam member of the cam tool comprises a rounded shape such as a circle, semi-circular, oval, or any other fraction of a circle or oval. The axis of rotation is off-center with respect to the outer tile engaging surface of the cam member so that the rotation axis is a different distance from each point on the tile engaging surface. An opening in the cam member is adapted to receive the engagement member extending from the base member such that rotating the cam tool around the engagement member of the bottom plate causes the tile engaging surface to get closer to the bottom plate. Since the axis of rotation is off-center, the tile engaging surface gets closer to the bottom plate as the cam tool is rotated thereby allowing the tile(s) to be compressed between the cam member and the bottom plate. A locking pawl assembly allows the cam tool to be rotated in a first direction relative to the base member but not in a second (opposite) direction.

Yet another aspect of the invention relates to a method of using an assembly for laying and leveling adjacent tiles. The method includes placing an assembly like the ones described above on a substrate surface. In use, one or more tiles are placed on the bottom plate on either side of the intermediate member and the cam tool is pivotally combined with the base member. The cam tool is rotated around the axis of rotation until the tile engaging surface on each of the cam members engages and compresses the tiles to secure the adjacent tiles at the same height as the setting bed cures and hardens. After the setting bed has cured and hardened, the intermediate member is separated from the bottom plate at the separate point. The cam tool may be reused in subsequent tile leveling operations.

DETAILED DESCRIPTION

The present invention is an assembly for laying, aligning, and leveling tiles. The assembly can be used to align and level tiles 26*a*, 26*b* that are being secured to any suitable substrate, including floors, walls, and countertops. It should be noted that words used in this specification such as upper, lower, top, and bottom, are relative to the device as it is shown in FIG. 1.

Figure 1:
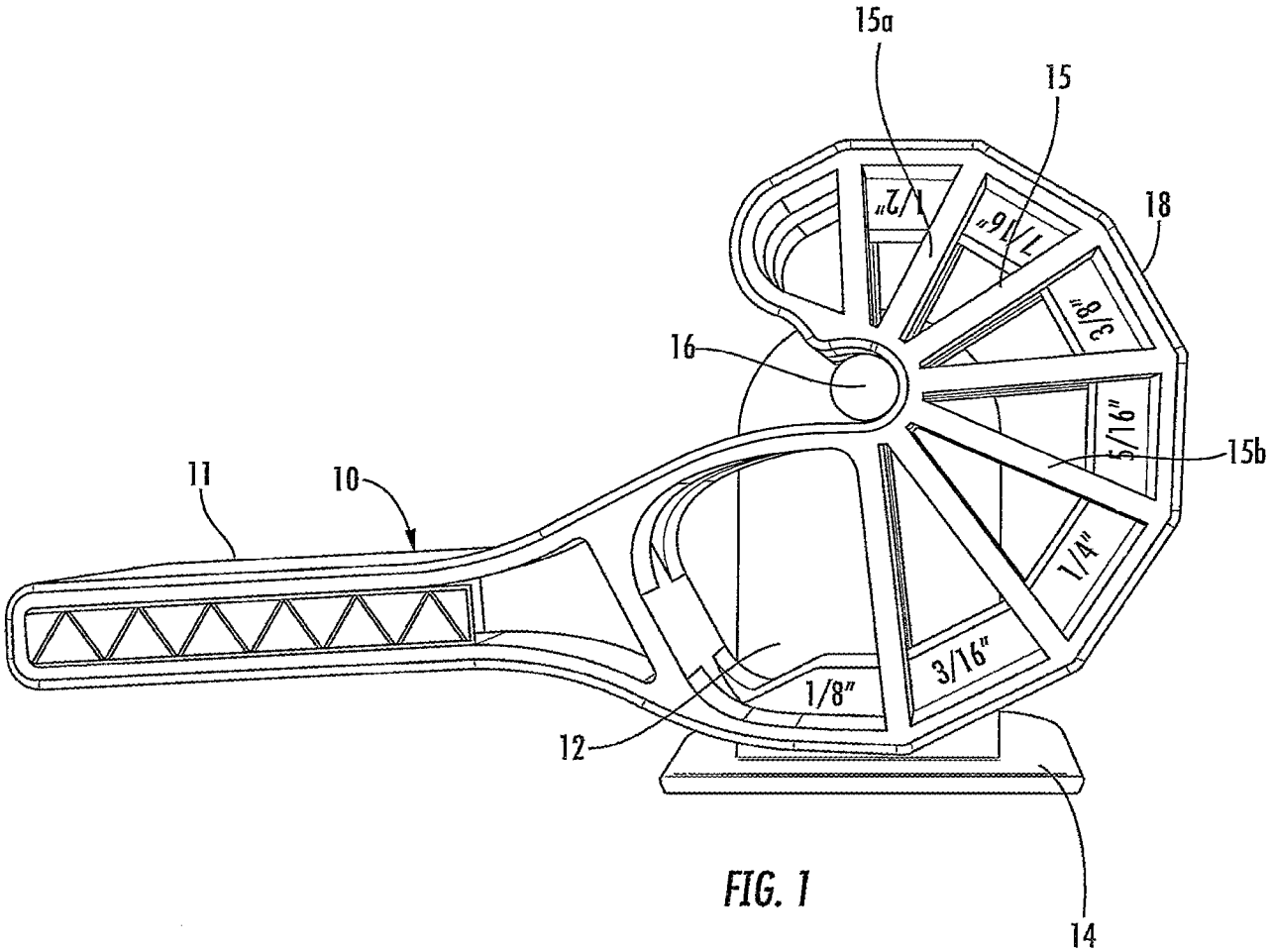
FIG. 1 is a side view of an embodiment wherein the cam tool is combined with the base member.
Figure 2:
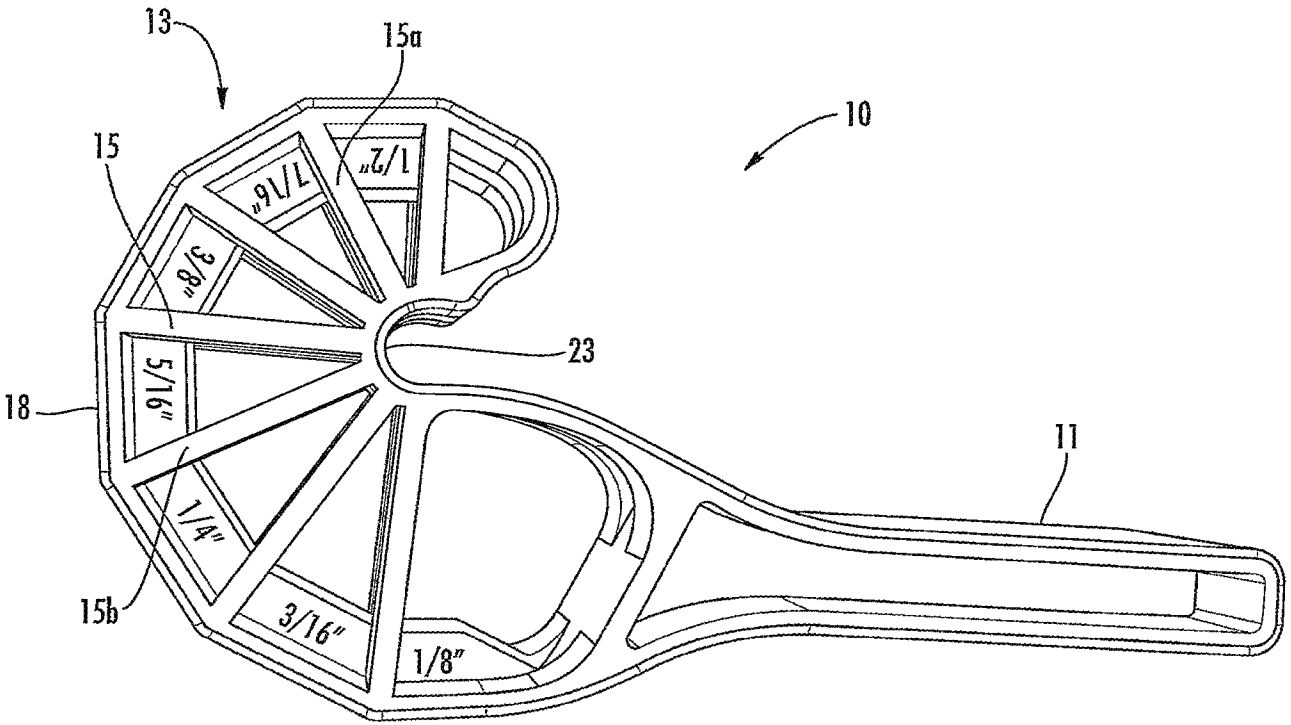
FIG. 2 is a side view of the cam tool.
Figure 3:
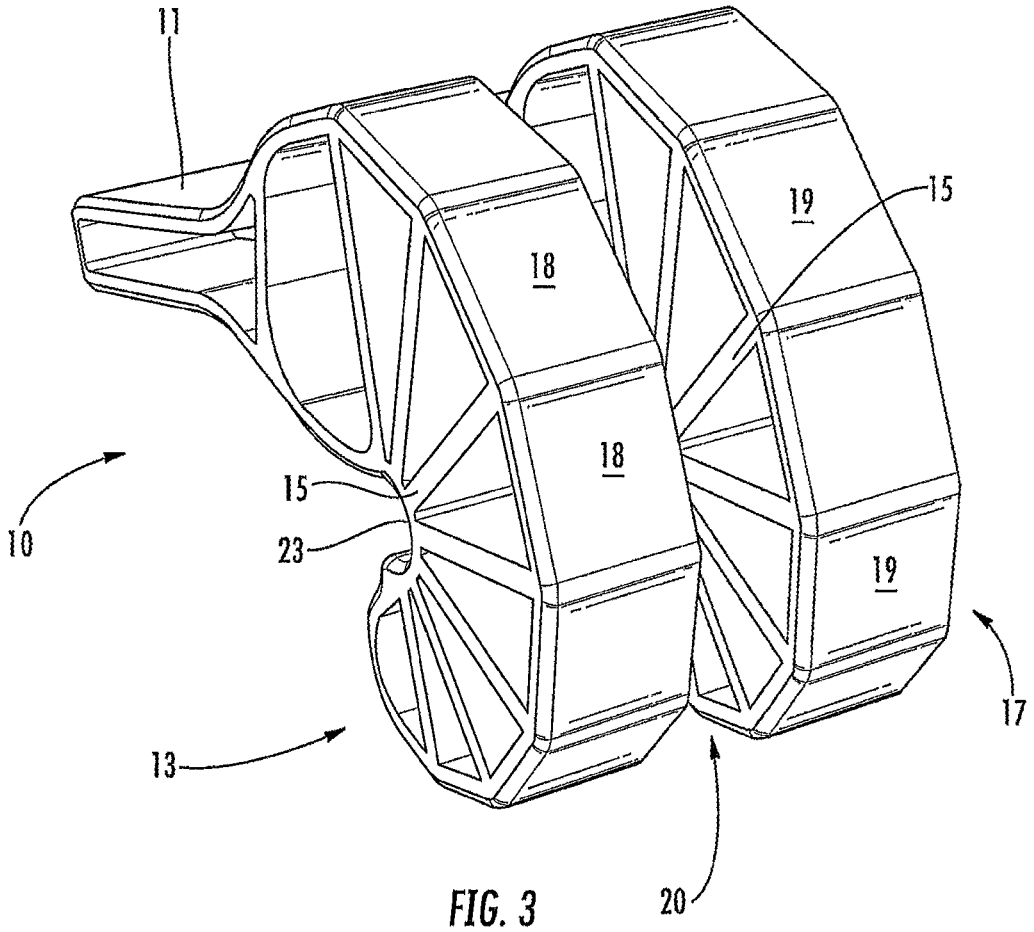
FIG. 3 is a perspective view of the cam tool.

FIG. 1 shows the general components of a first embodiment of the assembly. The assembly generally includes a cam tool 10 adapted to engage a portion of a base member 12 and rotate relative to the base member 12 around an axis of rotation. The cam tool 10 is shaped to convert rotational motion into linear (downward) motion/force as described herein. FIGS. 2 and 3 show the cam tool 10 without the base member 12. The cam tool 10 has a handle 11 combined with a cam member 13. The cam member 13 includes a tile engaging surface 18 around its outer periphery, wherein the tile engaging surface 18 includes multiple portions which are a different predetermined distance from the axis of rotation. In one embodiment the cam member 13 comprises a tile engaging surface 18 having a plurality of generally flat portions which are separated by vertices or corners. In one embodiment the plurality of flat portions of the tile engaging surface 18 form a polygon or a portion of a polygon (i.e., a polygon which is not completed or closed as shown in FIG. 1). The portions of the tile engaging surface 18 do not need to be the same length or be separated by the same angle. In another embodiment the tile engaging surface 18 is a continuous curve as described below with respect to FIGS. 9-13.

Figure 4:
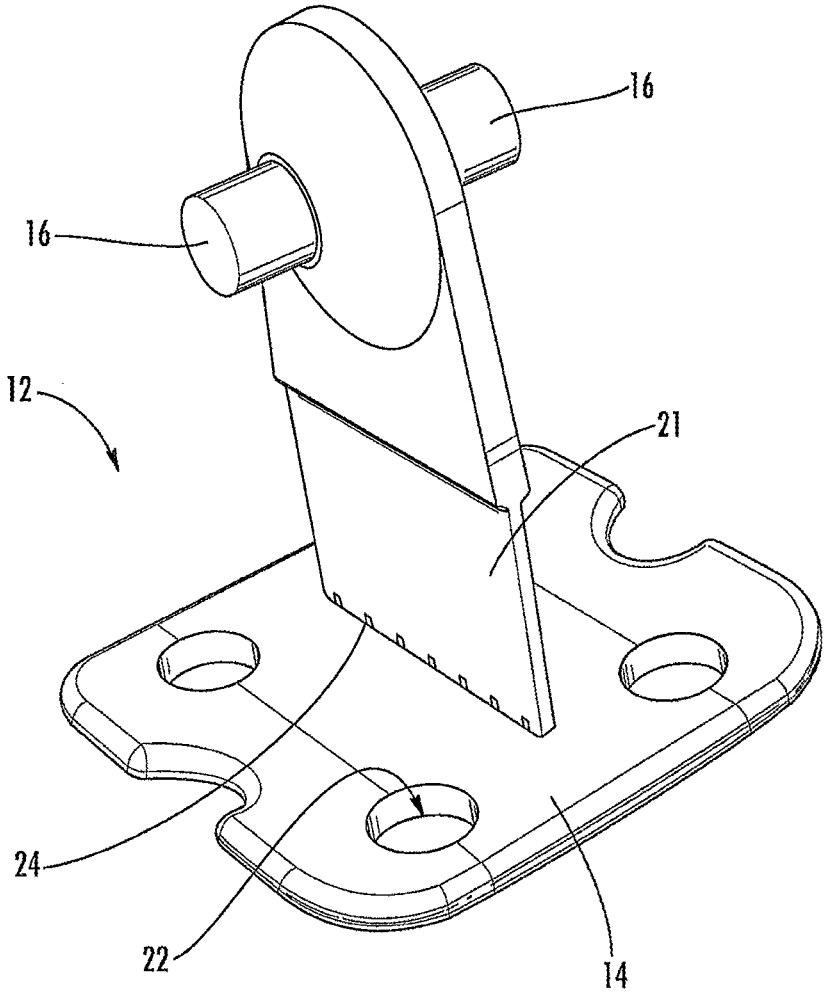
FIG. 4 is a perspective view of the base member.
Figure 5:
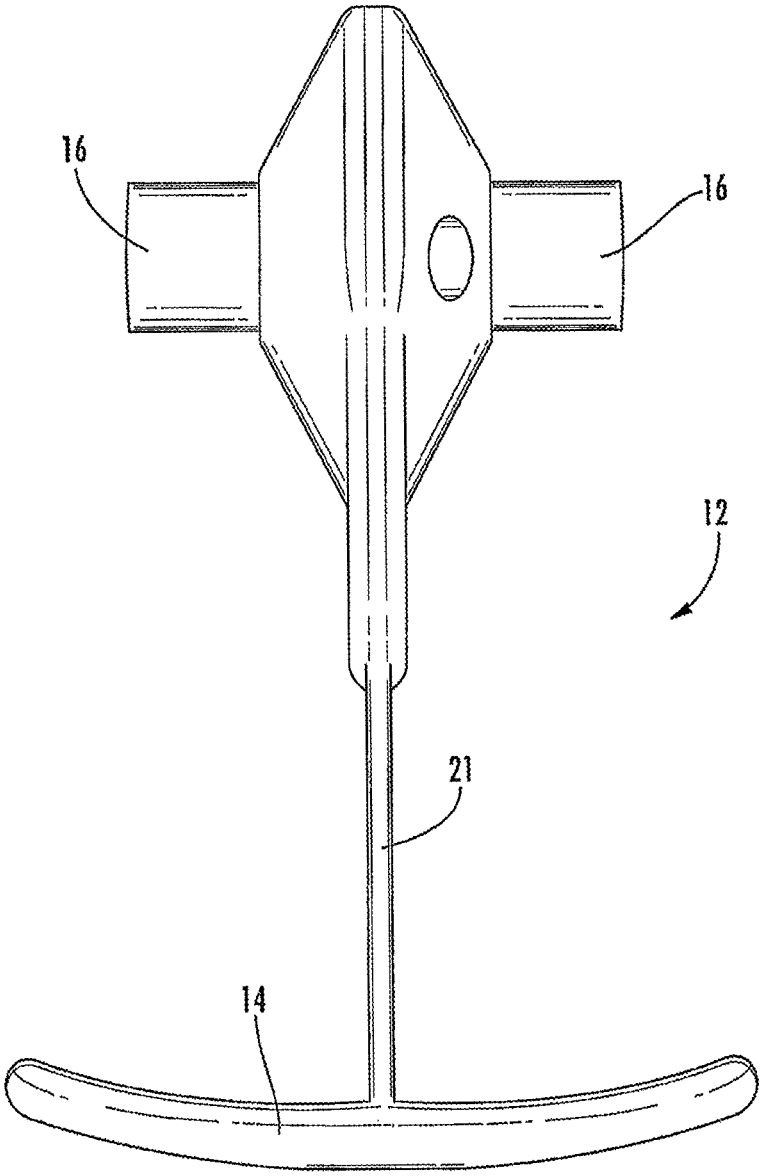
FIG. 5 is an end view of the base member.

The base member 12 is shown in FIGS. 4 and 5 without the cam tool 10. The base member 12 has a bottom plate 14 and an intermediate member 21 extending upwardly from the bottom plate 14. The intermediate member 21 includes at least one engagement member 16 such as a hub or shaft extending outwardly therefrom. There is a predetermined distance between the engagement member 16 and the bottom plate 14. The cam tool 10 may be combined with the base member 12 by any suitable means. In the embodiment shown, the cam tool 10 has an opening such as a notch which includes an engagement surface 23. The opening/notch is adapted to receive the engagement member 16 extending from the base member 12 to allow the components to rotate relative to each other around an axis of rotation. In other embodiments these components are reversed so that the opening/notch is in the base member 12 and the engagement member extends from the cam tool 10. In either case, the axis of rotation is off-center with respect to tile engaging surface 18 of the cam member 13 so that the axis of rotation is a different distance from various portions of the tile engaging surface 18. As explained in more detail below, the cam tool 10 rotates relative to the base member 12 causing each successive portion of the tile engaging surface 18 to face downward toward the bottom plate 14 as the cam tool 10 is rotated. Since the axis of rotation is off-center, each successive portion of the tile engaging surface 18 is a different distance from the bottom plate 14 when it is rotated to face downward toward the bottom plate 14. In one embodiment, starting at one end of the cam member 13, each successive portion of the tile engaging surface 18 is farther from the axis of rotation (and closer to the bottom plate 14)

as the cam tool 10 is rotated to reduce the space between the tile engaging surface 18 and the bottom plate 14 and increase the force applied to the tile(s) positioned between the components 14, 18. The compression of the engaging surface 18 against the tiles 26 helps ensure the top surface of the tiles 26 are held at the same elevation as the setting bed 28 dries to help reduce lippage between the tiles 26.

Figure 8:
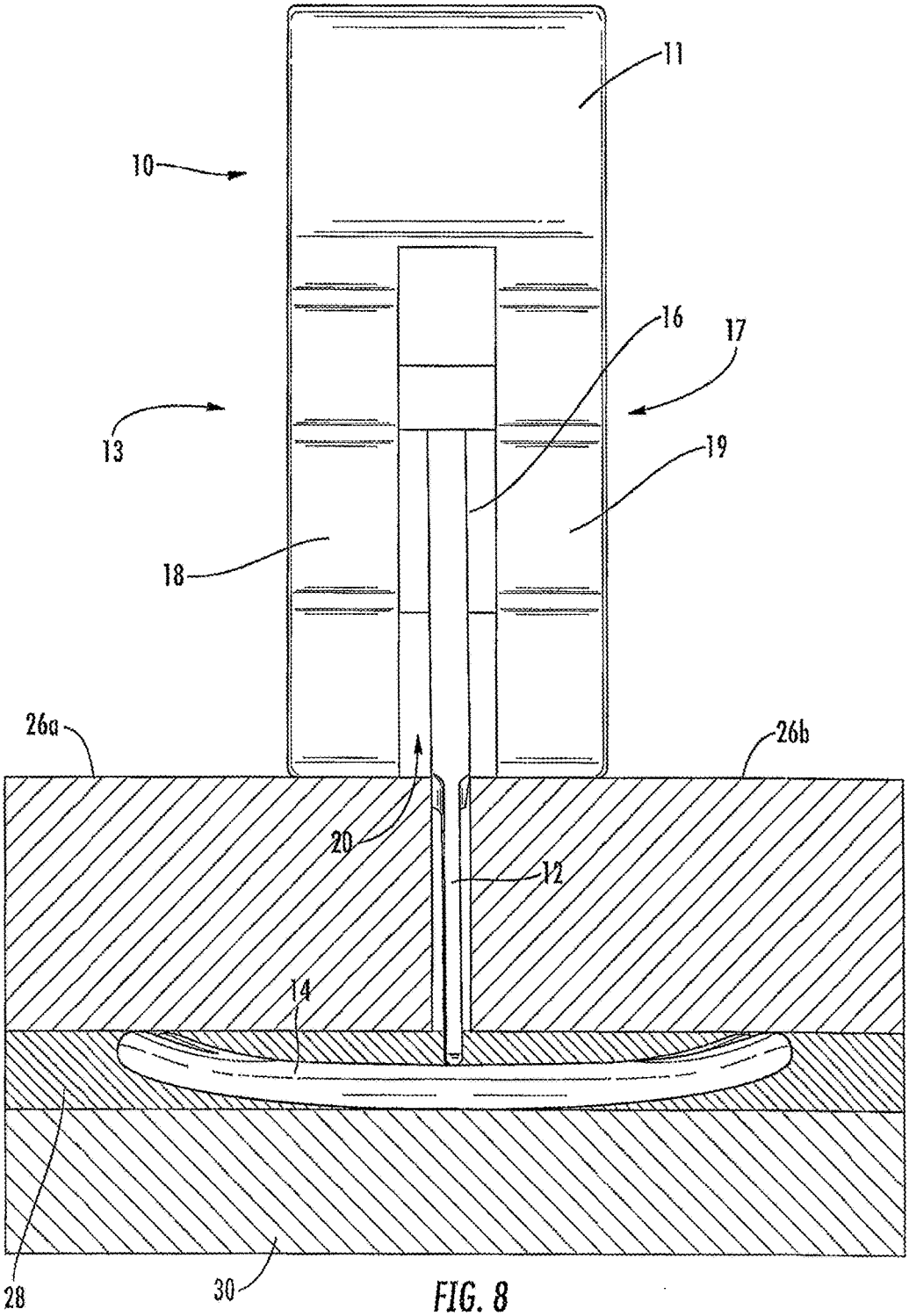
FIG. 8 is an end view showing the assembly secured against adjacent tiles.

As shown best in FIGS. 3 and 8, one embodiment of the cam tool 10 has a first cam member 13 separated from a second cam member 17 by a space or opening 20. Each cam member 13, 17 has a tile engaging surface 18, 19. The tile engaging surface 18 on the first cam member 13 is adapted to engage a first tile 26*a* on a first side of the base member 12 and the tile engaging surface 19 on the second cam member 17 is adapted to engage a second tile 26*b* on a second side of the base member 12. The opening 20 between the first cam member 13 and the second cam member 17 is at least large enough to allow the base member 12 to pass through as the cam tool 10 is rotated around the base member 12. In one embodiment the tile engaging surfaces 18, 19 are mirror images of each other so that they both engage their respective tiles 26*a*, 26*b* at the same time with the same amount of force. This helps to ensure that both tiles 26*a*, 26*b* are level with respect to each other as the mortar/setting bed 28 cures and hardens.

In use, the cam member 13 is rotated to a position where it engages the top surface of the tile 26*a*, 26*b* and presses the tile 26*a*, 26*b* downward against the bottom plate 14. If the tile 26*a*, 26*b* was removed, the distance between the tile engaging surface 18, 19 and the bottom plate 14 would be less than the thickness of the tile 26*a*, 26*b*. With the tile 26*a*, 26*b* in place, the cam member 13 and base member 12 have some elasticity allowing them to stretch from a first position to a second position to accommodate the thickness of the tile 26*a*, 26*b* positioned between these components 12, 13. The components 12, 13 are biased in their first position thereby creating a compressive force on the tile 26*a*, 26*b* as the components 12, 13 try to return to their first position. The compressive force helps keep the adjacent tiles 26*a*, 26*b* level relative to each other. The compressive force also helps keep the cam member 13 from rotating once it has been set against the tiles 26*a*, 26*b*. The force needed to rotate the cam member 13 one way or the other is greater than the force applied along the surface of the tile engaging surface 18, 19 because the distance from the rotation axis to the vertices or corners is greater than the distance from the rotation axis to the respective tile engaging surface 18, 19.

In one embodiment the cam tool 10 includes reinforcement members 15 such as spokes which separate the tile engaging surface 18 from the engagement surface 23. As shown in FIGS. 1-3, a first reinforcement member 15*a* is shorter than a second reinforcement member 15*b* so that the tile engaging surface 18 adjacent to second reinforcement member 15*b* extends out farther from the rotation axis than the tile engaging surface 18 adjacent to the first reinforcement member 15*a*. This allows the portion of the tile engaging surface 18 adjacent to the second reinforcement member 15*b* to be closer to the bottom plate 14 than the portion of the tile engaging surface 18 adjacent to the first reinforcement member 15*a* when the respective portions of surface 18 are rotated to face the bottom plate 14.

Figure 6:
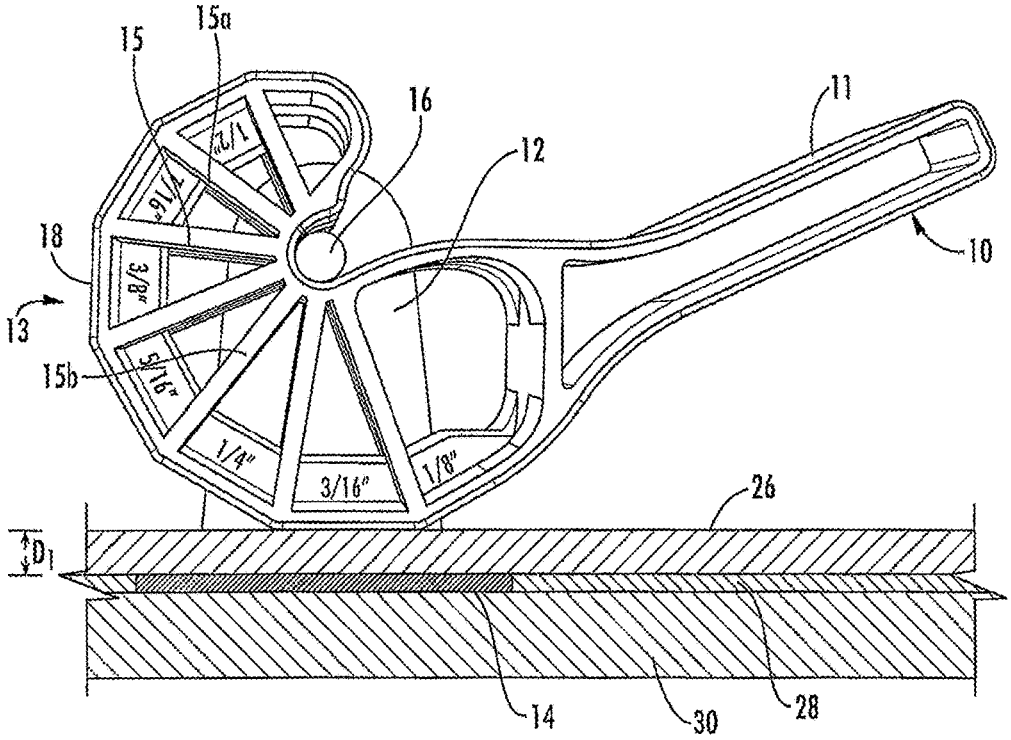
FIG. 6 is a side view showing the assembly secured against adjacent tiles having a first thickness.
Figure 7:
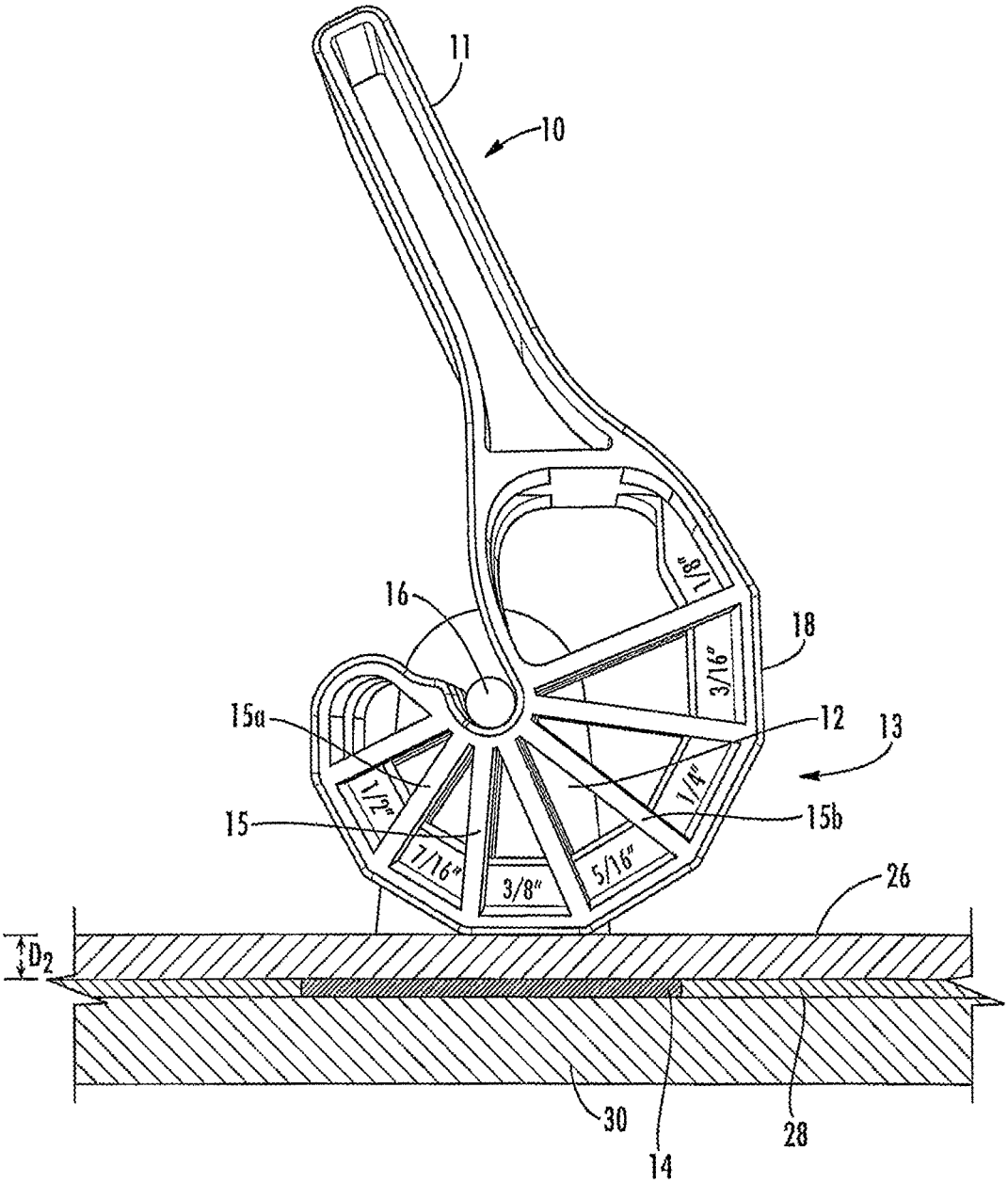
FIG. 7 is a side view showing the assembly secured against adjacent tiles having a second thickness.

One embodiment of the cam tool 10 includes visual markings which correspond to each tile engaging surface 18 to inform the user which surface 18 is intended for use with which tile thickness. In use, the thinner the tile 26*a*, the farther the tile engaging surface 18 must be from the axis of rotation to apply the appropriate amount of compressive force to the tile 26*a*. Any suitable marking may be used, including English units (inches) and Metric units (millimeters). The embodiment shown uses fractions of an inch. In FIG. 6, for example, the tile thickness D1 is about 3/16 of an inch. The cam tool 10 is secured to the base member 12 then rotated (clockwise in this embodiment) until the 3/16 inch marking is facing downward and engaging the top surface of the tile 26. The 3/16 inch marking on the cam tool 10 indicates that the distance between the tile engaging surface 18 engaging the tile 26 to the top surface of the bottom plate 14 is about 3/16 of an inch (i.e., the height of the tile 26). Similarly, FIG. 7 shows a different tile 26 having a tile thickness D2 of about 3/8 of an inch. The distance between the tile engaging surface 18 facing downward to the top surface of the bottom plate 14 is about 3/8 of an inch. In some embodiments the actual distance between the downward facing engaging surface 18 and the bottom plate 14 is less than the distance shown by the visual marking to help ensure the engaging surface firmly engages the tile 26 and/or applies force to compress the tile 26 against the bottom plate 14.

Figure 9:
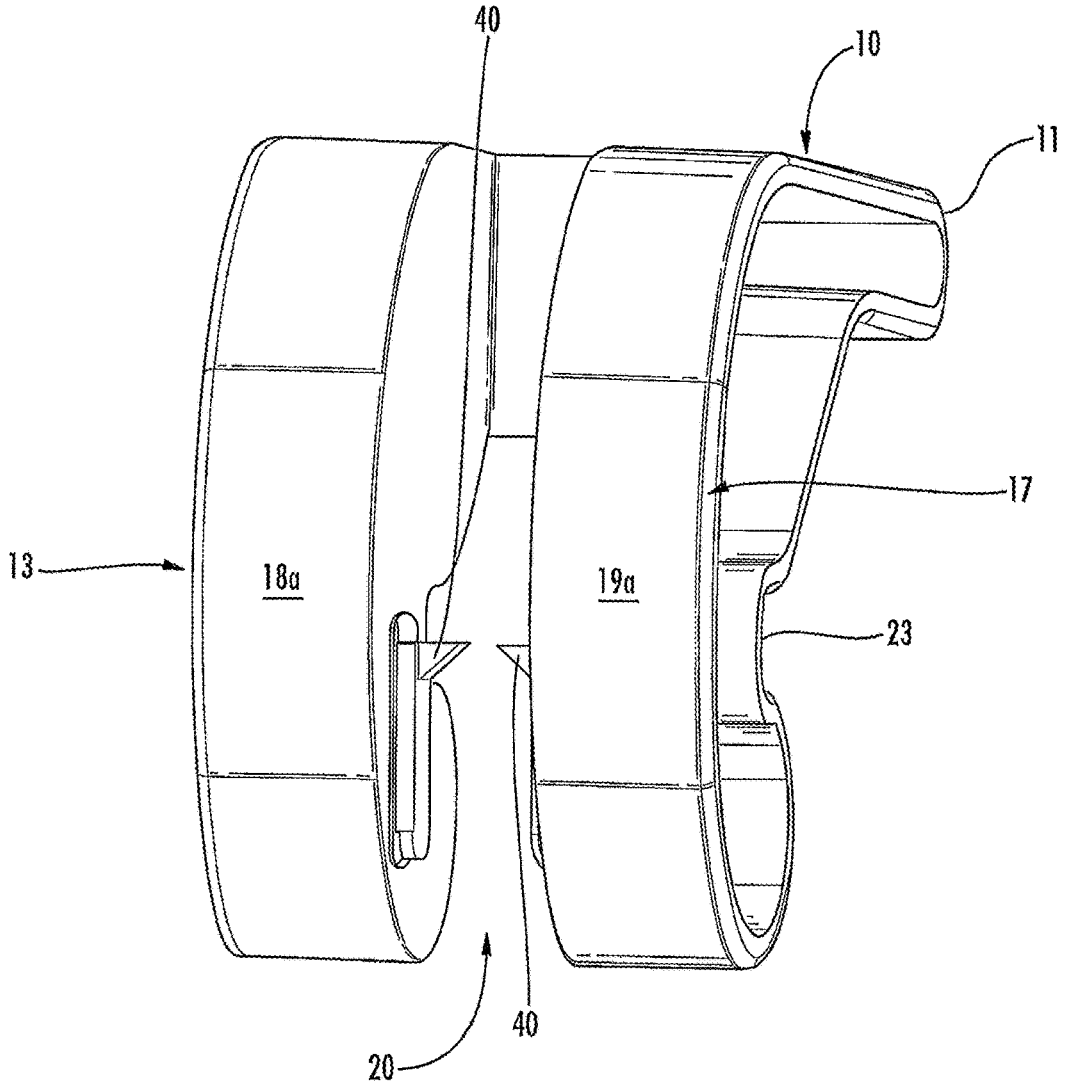
FIG. 9 is a perspective view of an alternate embodiment of the cam tool wherein the cam member has a curved tile engaging surface and a locking pawl means.
Figure 10:
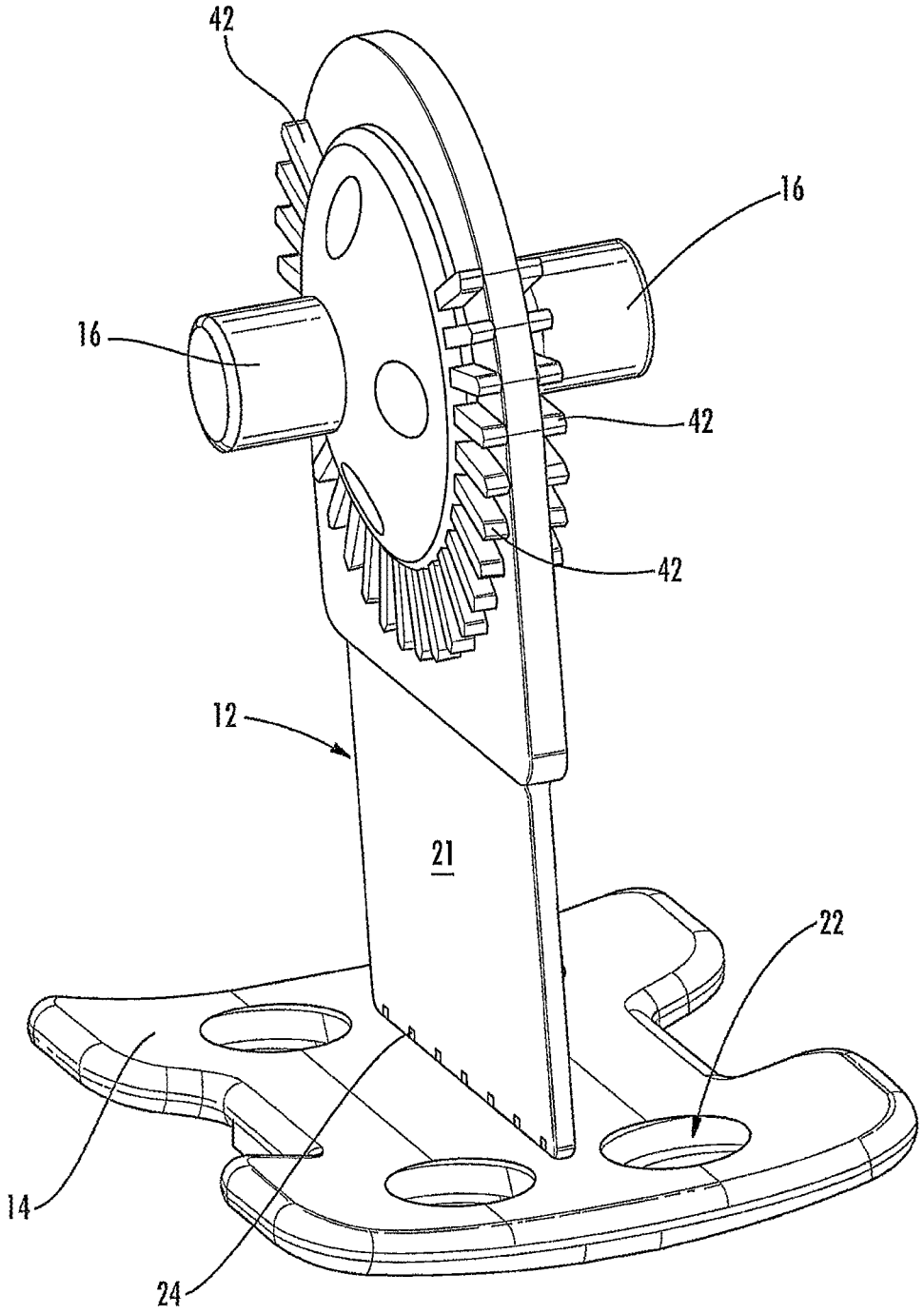
FIG. 10 is a perspective view of an alternate embodiment of the base member having a locking pawl means.
Figure 11:
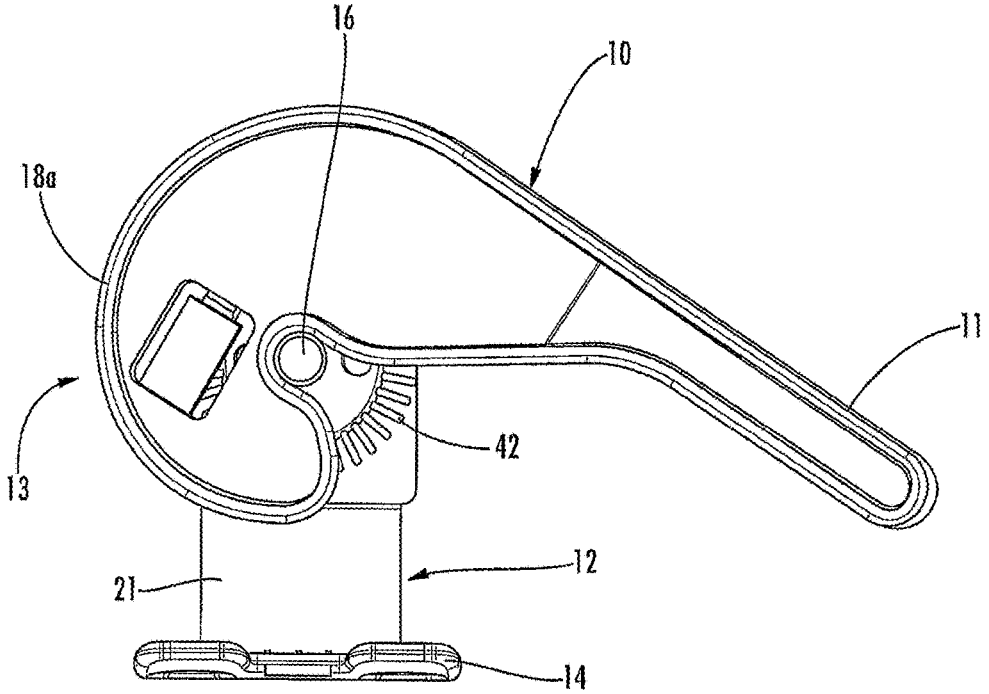
FIG. 11. is a side view showing the components of FIGS. 9 and 10 combined together.
Figure 12:
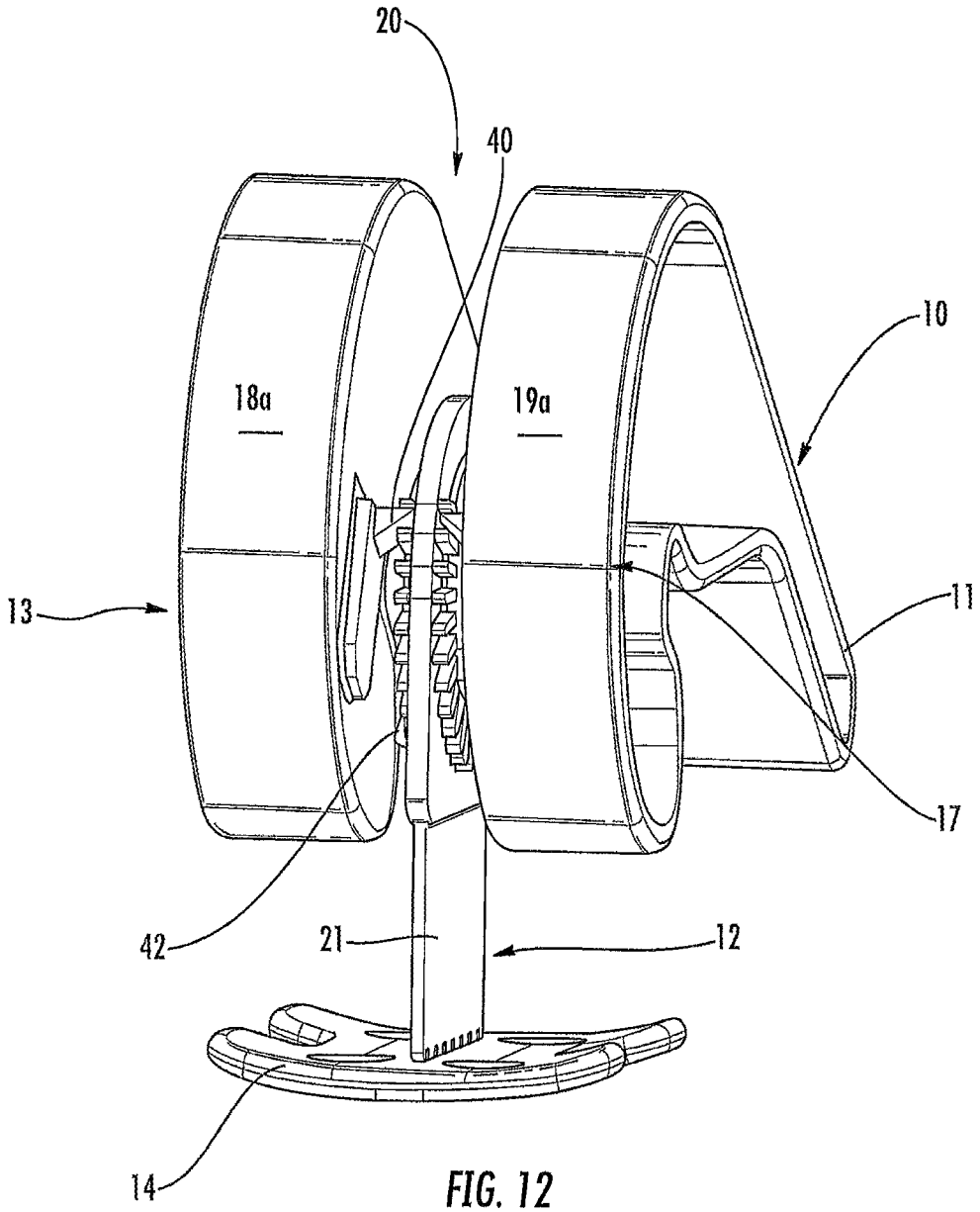
FIG. 12 is a perspective view showing the components of FIGS. 9 and 10 combined together.
Figure 13:
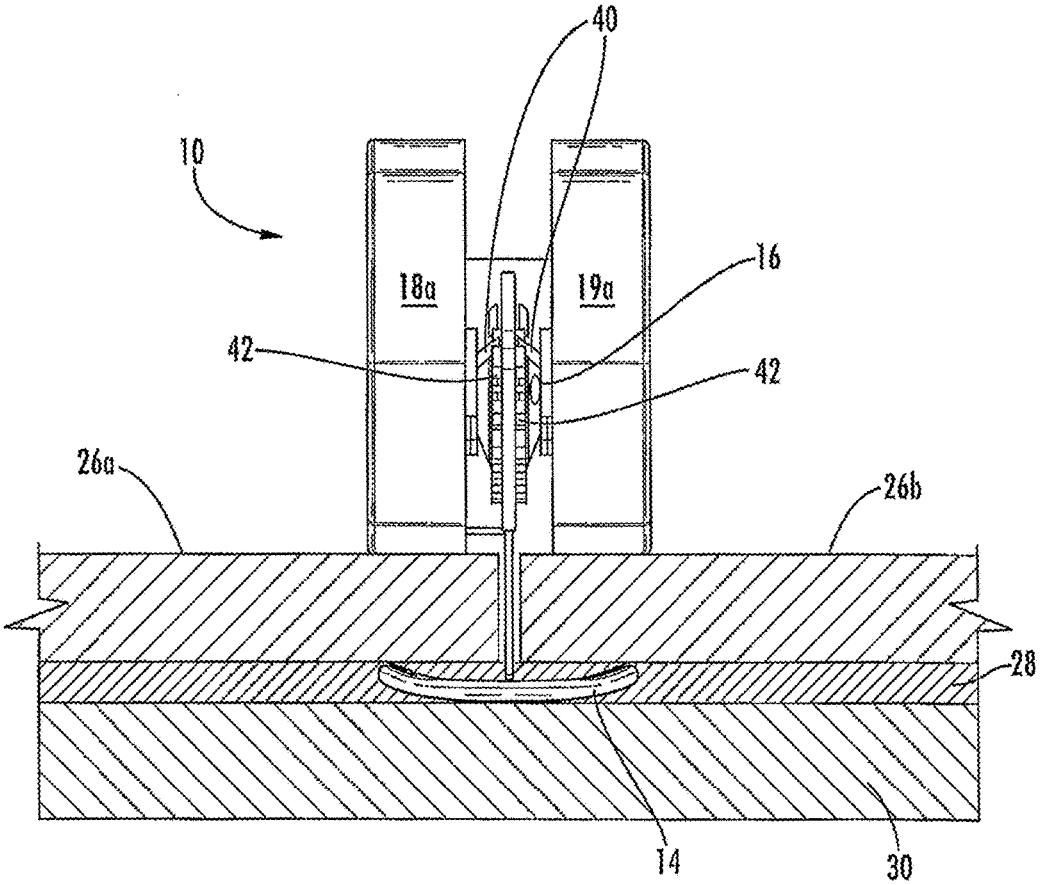
FIG. 13. is an end view showing the components of FIGS. 9 and 10 secured against adjacent tiles.

FIGS. 9-14 show an alternate embodiment wherein the engagement surfaces 18*a*, 19*a* do not include a plurality of flat portions. Instead, the engagement surfaces 18*a*, 19*a* are curved such as a portion of a circle or oval as shown best in FIG. 11. In this embodiment, the engagement surfaces 18*a*, 19*a* are secured against the tiles 26*a*, 26*b* by rotating the cam tool 10 relative to the base portion 12 as described in the previous embodiment. In this embodiment, however, a locking assembly such as a ratchet or locking pawl assembly secures the cam tool 10 relative to the base portion 12 after the cam tool 10 has been rotated to a desired position applying a desired amount of force against the tiles 26*a*, 26*b*. FIG. 9 shows the finger or pawl members 40 extending inward from each tile engaging surface 18*a*, 19*a* of the cam tool 10. FIG. 10 shows the gear or teeth members 42 combined with the base member 12 around the axis of rotation and adapted to interfere with the pawl members 40 as the cam tool 10 is rotated. One of the pawl members 40 and the teeth members 42 are asymmetrical thereby allowing the components 40, 42 to move past each other in a first direction but not in a second (opposite) direction. It should be noted that in some embodiments these components are reversed with the pawl members 40 on the base member 12 and the teeth 42 on the cam tool 10. The locking assembly allows the cam tool 10 to rotate relative to the base member 12 in a first direction but not in a second (opposite) direction. FIGS. 12 and 13 are other views of the components showing the locking assembly.

As shown best in FIG. 4, the bottom plate 14 preferably comprises one or more openings 22. The openings 22 allow the setting bed material 20 to seep through the bottom plate 14 to bond with the portion of the tile 26*a*, 26*b* directly above the bottom plate 14, which otherwise may not contact much of the setting bed material 28. Further, the seepage helps to ensure that the tiles 26*a*, 26*b* remain level as forces are applied to the bottom plate 14, setting bed material 28, and/or tiles 26*a*, 26*b* as the cam tool 10 is rotated to its tightened position. If the setting bed material 28 was not allowed to seep through the bottom plate 14, the setting bed material 28 could raise the bottom plate 14 as it dried which would consequently affect the level of the tiles 26*a*, 26*b*.

After the setting bed 28 dries and the tiles 26*a*, 26*b* are secured to the substrate 30, the user removes the portion of the device that is visible above the laid tiles 26*a*, 26*b*, i.e. the intermediate member 21. In one embodiment, the intermediate member 21 comprises a separation point 24 near the connection of the intermediate member 21 and the bottom plate 14 as seen in FIG. 5. The separation point 24 is structurally weaker than the remainder of the intermediate member 21 so that the user can apply force to the portion of the intermediate member 21 that extends above the tiles 26*a*, 26*b* and cause the intermediate member 21 to break at its separation point 24. The separation point 24 may comprise a single opening which allows the separation point 24 to be structurally weaker and separate when the proper force is applied by the user. Alternatively, the separation point 24 comprises a plurality of micro holes or perforations which allow the separation point 24 to be structurally weaker and separate when the proper force is applied by the user. In one embodiment, the curing process of the setting bed 28 pulls moisture out of the intermediate member 21 making it more brittle. This makes it easier for the user to break the intermediate member 21 at the separation point 24. Once separated at the separation point 24, the bottom plate 14 remains below the tiles 26*a*, 26*b* and is therefore not reusable. The cam tool 10, however, can be removed from the engagement member 16 and reused in subsequent tile laying operations.

FIGS. 5, 8, and 13 show an embodiment wherein at least a portion of the bottom plate 14 is comprised of a material that has a flexible or spring-like quality, such as a plastic composite. The outer edges or corners ("wings") of the bottom plate 14 are flexible and can move between a compressed position and an extended position. The outer edges of the bottom plate 14 are biased in their extended position. As the cam tool 10 is tightened against the top surface of the tiles 26, the flexible portions of the bottom plate 14 are compressed downward toward the substrate 30 and exert an upward force against the bottom of the tile 26 as they try to return to their extended position. The outer edges of the bottom plate 14 may be tapered so that they are thinner at the outer tip to allow the device to be easily inserted under tiles 26*a*, 26*b*.

The embodiment comprising the flexible portions of the bottom plate 14 is useful in situations where two adjacent tiles 26*a*, 26*b* have different thicknesses. The edges of the bottom plate 14 can be compressed under the weight of the thicker (heavier) tile 26*a*, while the flexible or spring-like quality of the bottom plate 14 can remain in its extended position under the thinner (lighter) tile 26*b* thereby holding the two adjacent tiles 26*a*, 26*b* at the same elevation. In the manner, the tile alignment and leveling device is self-adjusting after it has been placed under the tiles 26*a*, 26*b*. When the device is used at the intersection of four tiles, each of the outer corners of the bottom plate 14 can be positioned under each of the four tiles to independently hold each tile at the same elevation. Although this embodiment is shown in FIG. 4 as having four flexible wing portions, the flexible edges can be any other suitable shape with any suitable number of flexible wings.

FIGS. 6-8 and 13 show the assembly being used to level and align adjacent tiles 26*a*, 26*b*. It should be appreciated that any number of assemblies may be used to align dozens or hundreds of tiles during the installation of a single tile surface. In use, a typical first step in laying tile 26*a*, 26*b* is to apply a setting bed 28 such as mortar or cement to the substrate surface 30. After the setting bed 28 is applied, the tiles 26*a*, 26*b* can be placed on the substrate surface 30 in the setting bed 28 then the tiles 26*a*, 26*b* are placed on the bottom plate 14. In use, the bottom plate 14 is positioned in the setting bed 28 beneath the tiles 26*a*, 26*b* so that the intermediate member 21 extends upward between adjacent tiles 26*a*, 26*b* as shown in FIG. 8. The cam tool 10 is combined with the engagement member 16 then rotated so that the distance between the axis of rotation and the engagement surface 18 increases (clockwise in FIGS. 6 & 7). The rotation continues until the engagement surface 18 presses firmly on the top surface of the tile 26*a*, 26*b*. The tiles 26*a*, 26*b* are secured between the bottom plate 14 and the tile engaging surface 18 so that adjacent tiles 26*a*, 26*b* are level regardless of whether the underlying substrate material 30 is level. The bottom plate 14 does not need to rest on the substrate in order for the tiles 26*a*, 26*b* to be level. The bottom plate 14 may even be suspended above the substrate 30 as long as at least a portion of the tile 26*a*, 26*b* is contacting the setting bed 28 and as long as the tiles 26*a*, 26*b* are level relative to each other. The bottom plate 12 and engagement surface 18 hold the tiles 26*a*, 26*b* at the same height so that corners and/or edges of the adjacent tiles 26*a*, 26*b* remain aligned and level as the setting bed 28 cures and hardens.

After the setting bed 28 dries, and the tiles 26*a*, 26*b* are secured to the substrate 30, the user removes the portion of the device that is visible above the laid tiles 26*a*, 26*b*. As seen in FIG. 4, the base member 12 comprises a separation point 24 near the connection of the base member 12 and the bottom plate 12. In the preferred embodiment, the separation point 24 is structurally weaker than the remainder of the base member 12 so that the user can twist the base member 12 above the tiles 26*a*, 26*b* and cause the base member 12 to break at the separation point 24. Although the separation point 24 is capable of breaking when twisted, it is strong enough so that when force is applied longitudinally along the length of the base member 12, the base member 12 does not break. Once separated at the separation point 24, the bottom plate 14 remains below the tiles 26*a*, 26*b* and is therefore not reusable. The cam tool 10, however, can be removed from the base member 12 and reused in subsequent tile laying. As discussed above, the base member 12 is preferably made of a semi-rigid plastic, which helps the base member 12 to more easily be broken at its separation point 24.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included with in the scope of the following claims. Further, the invention is described herein to include several different features, all of which may be used with any of the embodiments described herein.

What is claimed is as follows:

1. A tile alignment assembly comprising:

a base member having a bottom plate;

a cam tool pivotally combined with the base member to rotate around an axis of rotation, said cam tool having a handle combined with a cam member, wherein the cam member has a rounded tile engaging surface with a plurality of successive points, wherein each successive point is farther from the axis of rotation so the distance between the tile engaging surface and the bottom plate decreases as the cam tool is rotated in a first direction;

a locking assembly combined with the base member and the cam tool, said locking assembly allowing the cam tool to rotate in a first direction relative to the base member but not in a second direction relative to the base member.

2. The tile alignment assembly of claim 1 wherein the tile engaging surface of the cam member is a smooth curve.

3. The assembly of claim 1 wherein the cam tool further comprising a second cam member combined with the handle, wherein the second cam member has a tile engaging surface which generally mirrors the tile engaging surface on the cam member.

4. A tile alignment assembly comprising:

a base member having a bottom plate;

a cam tool pivotally combined with the base member to rotate around an axis of rotation, said cam tool having an handle combined with a cam member;

wherein the cam member has a rounded tile engaging surface spaced a distance from the bottom plate;

wherein the tile engaging surface has a plurality of successive points, wherein each successive point of the tile engaging surface is farther from the axis of rotation so the distance between the tile engaging surface and the bottom plate decreases as the cam tool is rotated in a first direction;

a locking assembly combined with the base member and the cam tool, said locking assembly allowing the cam tool to rotate in a first direction relative to the base member but not in a second direction relative to the base member.

5. The tile alignment assembly of claim 4 wherein the tile engaging surface of the cam member is a smooth curve.

6. A tile alignment assembly comprising:

a base member having a bottom plate;

a cam tool pivotally combined with the base member to rotate around an axis of rotation, said cam tool having an handle combined with a cam member, wherein the cam member has a smooth and rounded tile engaging surface with a first point that is a first distance from the axis of rotation and a second point that is a second distance from the axis of rotation;

a locking assembly combined with the base member and the cam tool, said locking assembly allowing the cam tool to rotate in a first direction relative to the base member but not in a second direction relative to the base member.

7. The tile assembly of claim 6 wherein the locking assembly is a locking pawl assembly.

8. The assembly of claim 7 wherein the locking pawl assembly includes pawl members combined with the cam tool and teeth combined with the base member.

9. The assembly of claim 6 wherein the cam tool further comprising a second cam member combined with the handle, wherein the second cam member has a tile engaging surfaces around an outer periphery, and wherein the tile engaging surface of the second cam member has a first point that is a first distance from the axis of rotation and a second point that is a second distance from the axis of rotation.

10. A tile alignment assembly comprising:

a base member having a bottom plate;

a cam tool pivotally combined with the base member to rotate around an axis of rotation, said cam tool having an handle combined with a cam member;

wherein the cam member has a smooth and rounded tile engaging surface around an outer periphery, and wherein the tile engaging surface has a first point that is a first distance from the axis of rotation and a second point that is a second distance from the axis of rotation; and a locking assembly combined with the base member and the cam tool, said locking assembly allowing the cam tool to rotate in a first direction relative to the base member but not in a second direction relative to the base member.

11. The assembly of claim 10 wherein the locking assembly is a locking pawl assembly.

12. The assembly of claim 11 wherein the locking pawl assembly includes pawl members combined with the cam tool and teeth combined with the base member.

13. The assembly of claim 10 wherein the cam tool further comprising a second cam member combined with the handle, wherein the second cam member has a tile engaging surfaces around an outer periphery, and wherein the tile engaging surface of the second cam member has a first point that is a first distance from the axis of rotation and a second point that is a second distance from the axis of rotation.

* * * * *